US012480493B2

(12) United States Patent
Ayar et al.

(10) Patent No.: US 12,480,493 B2
(45) Date of Patent: Nov. 25, 2025

(54) DEVICE FOR COMPRESSING A GASEOUS FLUID AND METHOD FOR OPERATING THE DEVICE

(71) Applicant: Hanon Systems, Daejeon (KR)

(72) Inventors: Ayhan Ayar, Cologne (DE); Gerd Vondahlen, Gangelt (DE); Alex Rybski, Cologne (DE)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/557,545

(22) PCT Filed: Oct. 25, 2022

(86) PCT No.: PCT/KR2022/016331
§ 371 (c)(1),
(2) Date: Oct. 26, 2023

(87) PCT Pub. No.: WO2023/120930
PCT Pub. Date: Jun. 29, 2023

(65) Prior Publication Data

US 2024/0369062 A1 Nov. 7, 2024

(30) Foreign Application Priority Data

Dec. 23, 2021 (DE) ..... 10 2021 134 500.6
Oct. 13, 2022 (DE) ..... 10 2022 126 765.2

(51) Int. Cl.
*F04C 28/26* (2006.01)
*F04C 18/02* (2006.01)
*F04C 28/28* (2006.01)

(52) U.S. Cl.
CPC ..... *F04C 28/26* (2013.01); *F04C 18/0215* (2013.01); *F04C 18/0253* (2013.01)

(58) Field of Classification Search
CPC ..... F04C 28/26; F04C 28/28; F04C 18/0215; F04C 18/0253
See application file for complete search history.

(56) References Cited

U.S. PATENT DOCUMENTS 4,940,395 A * 7/1990 Yamamoto ..... F04C 28/16 417/310
5,722,257 A * 3/1998 Ishii ..... F04C 29/0035 62/505

(Continued)

FOREIGN PATENT DOCUMENTS

JP 2730248 B2 3/1998
JP 2005264752 A 9/2005

(Continued)

OTHER PUBLICATIONS

The English WO2019022037 by PE2E, Feb. 3, 2025.*
English translation of KR950010175 by PE2E May 16, 2025.*
English KR-101909606 by PE2E, Aug. 26, 2025.*

*Primary Examiner* — Deming Wan
(74) *Attorney, Agent, or Firm* — Shumaker, Loop & Kendrick, LLP; James D. Miller

(57) ABSTRACT

A device for compressing a gaseous fluid, in particular a refrigerant in a refrigerant circuit, specifically of an air-conditioning system of a motor vehicle. The device has a housing, a compression mechanism for compressing the gaseous fluid, and an electric motor for driving the compression mechanism. The housing is formed with a suction-pressure chamber and a high-pressure chamber.

12 Claims, 3 Drawing Sheets

(56) References Cited

U.S. PATENT DOCUMENTS

| | | | | |
|---|---|---|---|---|
| 6,176,685 | B1 | 1/2001 | Iizuka et al. | |
| 2003/0085533 | A1 | 5/2003 | Spiegl et al. | |
| 2004/0191083 | A1* | 9/2004 | Gennami | F04C 23/008 417/310 |
| 2006/0254309 | A1 | 11/2006 | Takeuchi et al. | |
| 2007/0217938 | A1* | 9/2007 | Cho | F04C 28/26 417/440 |

FOREIGN PATENT DOCUMENTS

| | | | | |
|---|---|---|---|---|
| JP | 2021192238 | A | 12/2021 | |
| KR | 950010175 | B1 * | 9/1995 | F04C 18/02 |
| KR | 20050073143 | A | 7/2005 | |
| KR | 20140114740 | A | 9/2014 | |
| KR | 101909606 | B1 * | 10/2018 | F04C 18/02 |
| WO | WO-2019022037 | A1 * | 1/2019 | F04C 18/02 |
| WO | 2021192238 | A1 | 9/2021 | |

* cited by examiner

[Fig. 1a]
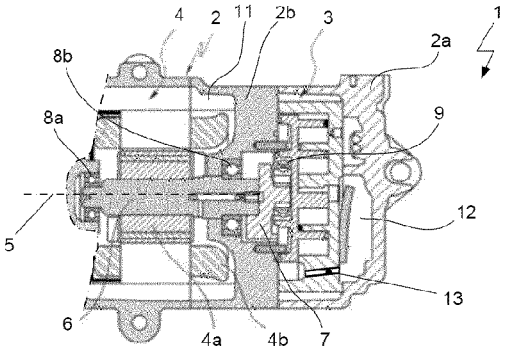
Fig. 1B
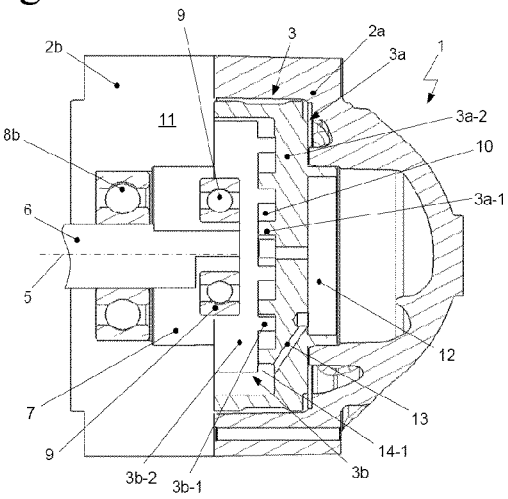
Fig. 2A
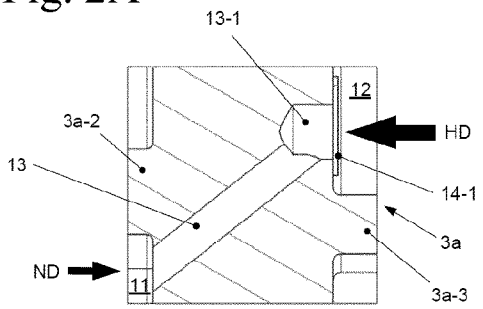
Fig. 2B
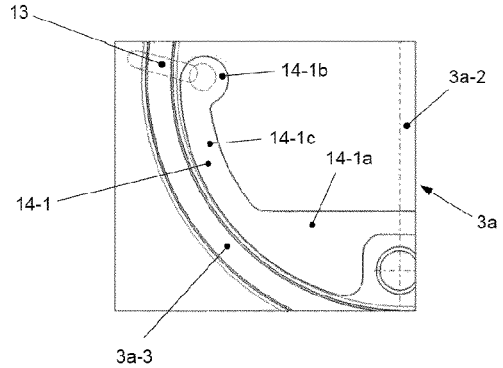

DEVICE FOR COMPRESSING A GASEOUS FLUID AND METHOD FOR OPERATING THE DEVICE

CROSS REFERENCE TO RELATED PATENT APPLICATIONS

This is a U.S. national phase patent application of PCT/KR2022/016331 filed Oct. 25, 2022 which claims the benefit of and priority to German Patent Application No. 10 2022 126 765.2 filed Oct. 13, 2022 and German Patent Application No. 10 2021 134 500.6 filed on Dec. 23, 2021, the entire contents of each of which are incorporated herein by reference.

TECHNICAL FIELD

The invention relates to a device for compressing a gaseous fluid, in particular a refrigerant of a refrigerant circuit, specifically of an air-conditioning system of a motor vehicle. The device has a housing, a compression mechanism for compressing the gaseous fluid, and an electric motor for driving the compression mechanism. The invention also relates to a method for operating the device.

BACKGROUND ART

Compressors known in the prior art for mobile applications, in particular for air-conditioning systems of motor vehicles, for conveying refrigerant through a refrigerant circuit, also referred to as refrigerant compressors, are often designed as piston compressors with a variable stroke volume or as scroll compressors, independently of the refrigerant. The compressors are driven either via a pulley or electrically.

Conventional electrically driven scroll compressors are designed with an electric motor arranged in a housing and with a compression mechanism which is connected mechanically to the electric motor.

The compression mechanism of the scroll compressor has an immovable, stationary spiral with a disc-shaped baseplate and with a spiral-shaped wall which extends from the baseplate, and a movable spiral with a disc-shaped baseplate and with a spiral-shaped wall which extends from the baseplate. The immovable, stationary spiral and the movable spiral, which is also referred to as the orbiter or orbiting spiral, interact. The baseplates are arranged relative to one another such that the walls of the spirals engage in one another. The spiral-shaped walls form successive, closed working chambers.

The orbiter is moved on a circular path via an eccentric connected to a drive shaft, so that the spiral-shaped wall of the orbiter orbits around the stationary spiral-shaped wall of the immovable spiral. The working chambers are made smaller and the fluid is compressed by the contradirectional movement of the two nested, spiral-shaped walls. The gaseous fluid to be compressed is sucked into the compression mechanism, compressed inside the compression mechanism, and expelled via an outlet.

The electric motor has a stator with a substantially hollow-cylindrical stator core, coils wound on the stator core, and a rotor arranged inside the stator. The rotor is arranged coaxially inside the stator rotatably about a rotation axis and is set in rotation when the coils of the stator are supplied with electrical energy. The drive shaft, which is connected to the orbiter of the compression mechanism on one side and drives the orbiter to compress the vaporous fluid, is formed integrally with the rotor or is designed as a separate element of the electric motor on the other side.

With the compression mechanism driven by the electric motor, it is possible under some circumstances after the drive has been taken out of operation, for example by intentional switching off or by an unintentional interruption of the supply of electrical energy to the electric motor, in particular as a result of an accident, for an undesirable electrical voltage to be induced in the electric motor. The electric motor would then briefly act as a generator.

A possible cause of the operation deviating from operation in compressor mode when the electric motor is switched off results from the fluid flowing through the compression mechanism, which causes the compression mechanism to move. The compression mechanism is consequently driven not by the electric motor but by the fluid flowing through. During normal operation of the compressor in compressor mode, the fluid, in particular the refrigerant of the refrigerant circuit, specifically of the air-conditioning system of a motor vehicle, is compressed from a low pressure level to a higher pressure level as it flows through the compression mechanism.

The mass flow of the refrigerant caused during operation of the compressor deviating from operation in compressor mode when the electric motor is switched off can be caused by the refrigerant flowing out of the refrigerant circuit, the components of which also include the compressor. The mass flow of the refrigerant through the compressor can result in the movement of the compressor mechanism, specifically of the orbiter connected to the drive shaft, and thus in a movement of the magnetic rotor relative to the stator of the electric motor. As a result, an electrical voltage is induced inside the coils of the stator of the electric motor. To prevent a voltage induced in this manner exceeding defined threshold values, the entire air-conditioning system, in particular the refrigerant circuit including the compressor, must be protected.

Solutions based on the side of the electrical drive are known from the prior art and prevent or at least limit possible induction of the electrical voltage inside the coils of the electric motor resulting from the movement of the compression mechanism after the electric motor has been switched off, which increases the safety of the operation of the compressor. However, such electrical circuits for active or passive discharge are very cost-intensive to produce and maintain and require a large amount of effort for validation and documentation.

US 2006 0254309 A1 discloses a flow device having an expansion device of the scroll type, which is operated with a high-pressure refrigerant. The refrigerant is heated by means of waste heat from an engine of a motor vehicle. The flow device also has a motor generator for generating electrical energy. The motor generator is driven by means of a rotary force provided using the expansion device, wherein a rotating shaft of the motor generator is coupled to a movable spiral of the expansion device.

SUMMARY

The object of the invention consists in providing a device for compressing a gaseous fluid, which device can be operated with maximum safety. In particular, when the electrical drive of the device is taken out of operation, electrical voltage should be prevented from being generated inside the device and being applied from the device to the electrical system of the motor vehicle. The device is intended to have a simple design consisting of a minimal number of components with a minimal space requirement. In addition, the costs for production, maintenance, assembly and operation should be minimal.

The object is achieved by the subjects having the features as shown and described herein.

The object is achieved by a device according to the invention for compressing a gaseous fluid, in particular a refrigerant of a refrigerant circuit, specifically of an air-conditioning system of a motor vehicle. The device has a housing, a compression mechanism for compressing the gaseous fluid, and an electric motor for driving the compression mechanism. The housing is formed with a suction-pressure chamber and a high-pressure chamber.

According to the design of the invention, the device for compressing the gaseous fluid has a bypass flow path and a device for controlling a through-flow of the fluid through the bypass flow path. The bypass flow path is in particular designed solely to flow-connect the suction-pressure chamber and the high-pressure chamber to one another. The device for controlling the through-flow of the fluid is designed to open the bypass flow path solely for the fluid to flow through in a flow direction from the suction-pressure chamber into the high-pressure chamber depending on the respective pressure level of the fluid in the suction-pressure chamber and in the high-pressure chamber. The device is preferably mechanically actuated solely by the different pressure levels and thus the pressure difference between the pressure levels.

The device for compressing the gaseous fluid consequently has a bypass flow path which opens and closes in a pressure-dependent manner, from an original suction side to a pressure side. The bypass flow path is only opened when the fluid in the suction-pressure chamber has a higher pressure than in the high-pressure chamber. When the pressure of the fluid in the suction-pressure chamber is less than or equal to the pressure of the fluid in the high-pressure chamber, the bypass flow path remains closed.

The device for controlling the through-flow of the fluid through the bypass flow path is advantageously designed as a valve, in particular a non-return valve, which opens the bypass flow path in the flow direction of the fluid from the suction-pressure chamber into the high-pressure chamber as required and always closes it in a flow direction from the high-pressure chamber into the suction-pressure chamber.

The device for compressing the gaseous fluid is preferably designed as an electrically driven refrigerant compressor.

According to a development of the invention, the compression mechanism of the device for compressing the gaseous fluid has a stationary spiral and an orbiting spiral as components of a scroll compressor. The stationary or immovable spiral and the orbiting spiral are each designed with a baseplate and a spiral-shaped wall extending from the baseplate. The walls are arranged to engage in one another and form working chambers.

The flow direction of the fluid through the compression mechanism is limited by means of provided components to a certain direction, in particular from the suction side to the pressure side. The through-flow of the fluid through the compression mechanism in the opposite direction is prevented when the pressure on the pressure side is higher than on the suction side.

According to an advantageous embodiment of the invention, the electric motor has a rotor and a stator, said rotor being arranged inside the stator. The stator is designed with coils for generating an electromagnetic field and thus for driving the rotor, which is in particular arranged coaxially inside the stator and rotatably about a rotation axis.

The rotor can have a drive shaft or be connected to a drive shaft, which is arranged rotatably about the rotation axis. The drive shaft is also preferably mechanically connected to the orbiting spiral of the compression mechanism of the scroll compressor.

The bypass flow path can be formed at any suitable point inside or outside the device for compressing the gaseous fluid which is adjacent to both the high-pressure region and the low-pressure region of the device.

According to a preferred embodiment of the invention, the bypass flow path is formed inside the stationary spiral or inside a wall of the housing or outside the housing. If the bypass flow path is arranged inside the stationary spiral of the compression mechanism of the scroll compressor, the bypass flow path is in particular designed as a through-opening through the baseplate of the stationary spiral.

The device for controlling the through-flow of the fluid through the bypass flow path can be designed as any type of pressure-dependent opening mechanism, such as valves or lamellae.

According to a particularly advantageous embodiment of the invention, the device for controlling the through-flow of the fluid through the bypass flow path is designed as a lamellar valve.

When in the closed state, the lamellar valve can bear against a surface, facing the high-pressure chamber, of the baseplate of the stationary spiral and close the bypass flow path.

The device in the form of a lamellar valve for controlling the through-flow of the fluid preferably has a fastening region and a closing region, which are connected to one another via a neck-like connecting region. The device in the form of a lamellar valve and at least one outlet valve likewise in the form of a lamellar valve can be connected to one another at first ends, forming the fastening region, to form an integral unit. The device in the form of a lamellar valve and the at least one outlet valve are preferably arranged oriented in a common plane.

According to a development of the invention, the device in the form of a lamellar valve for controlling the through-flow is fixed at a first end with the fastening region to the baseplate of the stationary spiral. The device for controlling the through-flow is arranged so as to be able to close the bypass flow path with a free second end, formed distally from the first end, with the closing region.

The connecting region of the device for controlling the through-flow is advantageously formed over a length with a constant width, which is smaller than a diameter of the substantially circular closing region. The connecting region can have a constant outer radius such that the connecting region is designed as a section of a circular ring.

The outer radius of the connecting region preferably corresponds to an inner radius of a circular ring-shaped elevation protruding from a surface, facing the high-pressure chamber, of the baseplate of the stationary spiral, minus a clearance for the relative movement of the device in relation to the stationary spiral.

A ratio of the width of the connecting region to a longitudinal extent of the device for controlling the through-flow is advantageously 0.1. A ratio of the longitudinal extent to the radius of the connecting region of the device for controlling the through-flow in particular has a value within a range of 0.1 to 10.

According to an alternative embodiment, the device for controlling the through-flow of the fluid has a closure element and a spring element. The spring element is oriented to exert a spring force on the closure element to close the bypass flow path. The closure element can have the shape of a sphere or a truncated circular cone. The spring element can be designed as a cylindrical helical spring or as a spring plate.

The object of the invention is also achieved by a method according to the invention for operating the device for compressing the gaseous fluid having the housing with the suction-pressure chamber and the high-pressure chamber, the bypass flow path flow-connecting the suction-pressure chamber and the high-pressure chamber to one another, and the device for controlling the through-flow of the fluid through the bypass flow path. The method has the following steps:

closing the bypass flow path during operation of the device for compressing the gaseous fluid in a compressor mode, and opening the bypass flow path to allow fluid to flow through in a flow direction from the suction-pressure chamber into the high-pressure chamber.

The flow direction of the fluid is always set by pressure levels of the fluid inside the suction-pressure chamber and the high-pressure chamber.

This ensures that the compression mechanism which is actually taken out of operation is not unintentionally caused to move or activated as a result of fluid flowing through it. Because the fluid possibly flows at least in part through the bypass flow path instead of the compression mechanism, the compression mechanism, in particular the orbiting spiral, is not set in rotation, which would in turn be transmitted via the drive shaft to the rotor of the electric motor and would induce undesirably high voltages in the coils of the stator. At least, only such a small mass flow of the fluid flows through the compression mechanism that no undesirably high voltages are induced in the coils of the stator of the electric motor via the rotor being caused to move.

The advantageous embodiment of the invention, in particular with regard to the minimal number of components with minimal space requirement, allows the use of the device for compressing the gaseous fluid in a refrigerant circuit of an air-conditioning system of a motor vehicle.

The device for compressing the gaseous fluid can advantageously be used for various refrigerants such as R134a, R1234yf, R1234ze, R744, R600a, R290, R152a and R32.

In summary, the device according to the invention for compressing the gaseous fluid advantageously constitutes a simple design which requires only minimal costs for production, assembly and operation.

BRIEF DESCRIPTION OF DRAWINGS

Further details, features and advantages of embodiments of the invention can be found in the description of exemplary embodiments below with reference to the associated drawings. In the drawings:

FIG. 1A: shows a section through an electrically driven compressor with an electric motor as a device for driving a compression mechanism having a bypass flow path between a suction-pressure chamber and a high-pressure chamber, and FIG. 1B: shows a section through a detail of the compression mechanism of the compressor of FIG. 1A, FIG. 2A: shows a section through the bypass flow path formed inside a baseplate of a stationary spiral of the compression mechanism between the suction-pressure chamber and the high-pressure chamber with a device for controlling a through-flow in a first alternative embodiment.

DESCRIPTION OF AN EMBODIMENT

Figure 2C:
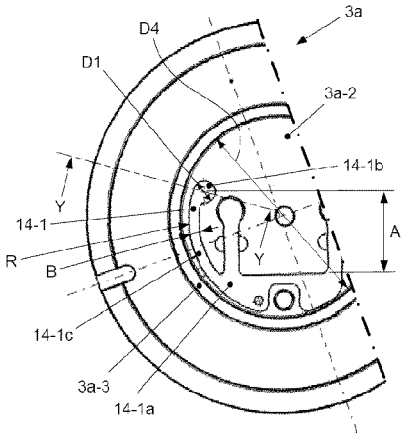
FIGS. 2B and 2C: each show a view from above of a device for controlling the through-flow of a first alternative embodiment according to FIG. 2A, FIG. 2D: shows a section through the bypass flow path formed between the suction-pressure chamber and the high-pressure chamber with the device for controlling a through-flow in the embodiment according to FIG. 2C, FIG. 3A: shows a view from above of a detail of the bypass flow path formed inside the baseplate of the stationary spiral of the compression mechanism with the device for controlling the through-flow.

FIG. 1A shows a section through an electrically driven device 1 for compressing a gaseous fluid, referred to below as compressor 1 for short, having an electric motor 4 arranged in a housing 2 as a device for driving a compression mechanism 3 to suck in, compress and expel refrigerant as gaseous fluid. The electric motor 4 is supplied with electrical energy. FIG. 1B shows a section through a detail of the compression mechanism 3 of the compressor 1 of FIG. 1A.

The electric motor 4 has a stator 4*b* with a substantially hollow-cylindrical stator core, coils wound on the stator core, and a rotor 4*a* arranged inside the stator 4*b*. The rotor 4*a* is set in rotation when the coils of the stator 4*b* are supplied with electrical energy. The rotor 4*a* is arranged coaxially inside the stator 4*b* and rotatably about a rotation axis 5. A drive shaft 6 can be formed integrally with the rotor 4*a* or as a separate element.

The electric motor 4 and the compression mechanism 3 formed with a stationary spiral 3*a* and an orbiting spiral 3*b* are arranged inside a volume enclosed by the housing 2. The housing 2 is formed from a first housing element 2*a* for accommodating the compression mechanism 3 and a second housing element 2*b* for accommodating the electric motor 4 and preferably from a metal, in particular aluminum.

The orbiting spiral 3*b* of the compression mechanism 3, in which the vaporous fluid, specifically the refrigerant, is compressed, is driven via the drive shaft 6 connected to the rotor 4*a* of the electric motor 4.

The stationary spiral 3*a* and the orbiting spiral 3*b* each have a baseplate 3*a*-2, 3*b*-2 and a spiral-shaped wall 3*a*-1, 3*b*-1 extending from the baseplate 3*a*-2, 3*b*-2. The baseplates 3*a*-2, 3*b*-2 are arranged relative to one another such that the walls 3*a*-1, 3*b*-1 engage in one another. The stationary spiral 3*a* is formed inside the housing 2 or as a part of the housing. The orbiting spiral 3*b* is coupled via an eccentric 7 to the drive shaft 6 rotating about the rotation axis 5 and is guided on a circular path. The drive shaft 6 is supported on the housing 2 using radial bearings 8*a*, 8*b*. The orbiting spiral 3*b* is retained on the drive shaft 6, in particular on the eccentric 7, via a radial bearing 9.

When the orbiting spiral 3*b* moves relative to the stationary spiral 3*a*, the spiral-shaped walls 3*a*-1, 3*b*-1 of the spirals 3*a*, 3*b* touch one another at multiple points and form multiple successive, closed working chambers 10 inside the walls 3*a*-1, 3*b*-1, wherein adjacently arranged working chambers 10 delimit volumes of different sizes. As a result of the movement of the orbiting spiral 3*b* relative to the stationary spiral 3*a*, the volumes and the positions of the working chambers 10 are changed. The volumes of the working chambers 10 become increasingly smaller towards the center of the spiral-shaped walls 3*a*-1, 3*b*-1. The gaseous fluid, in particular the gaseous refrigerant, to be compressed is sucked into the working space 10 through a suction chamber, also referred to as suction-pressure chamber 11 owing to the pressure of the refrigerant, compressed by the movement of the orbiting spiral 3*b* relative to the stationary spiral 3*a*, and expelled into an expulsion chamber, also referred to as high-pressure chamber 12 owing to the pressure of the refrigerant. The refrigerant, which is present in the high-pressure chamber 12 at the level of the high pressure of a refrigerant circuit, is conveyed out of the compressor 1 into the refrigerant circuit.

A bypass flow path 13 is provided inside the stationary spiral 3*a*. The bypass flow path 13 is designed as a through-opening and extends through the baseplate 3*a*-2 of the stationary spiral 3*a* to connect the suction-pressure chamber 11 to the high-pressure chamber 12 of the compressor 1. During operation of the compressor 1 in compressor mode and thus in normal operation of the compressor 1, according to FIGS. 1A and 1B, the bypass flow path 13 is closed by a device 14-1 for controlling a through-flow.

The device 14-1 for controlling the through-flow is designed as a valve, specifically as a non-return valve, which ensures flow of the fluid through the bypass flow path 13 in only one flow direction of the fluid from the suction-pressure chamber 11 into the high-pressure chamber 12 and prevents it in a direction opposite this flow direction from the high-pressure chamber 12 into the suction-pressure chamber 11. During flow through the bypass flow path 13 from the suction-pressure chamber 11 into the high-pressure chamber 12, the device 14-1 is open. Flow through the bypass flow path 13 from the high-pressure chamber 12 into the suction-pressure chamber 11, specifically during operation of the compressor 1 in compressor mode, is not possible.

Figure 2D:
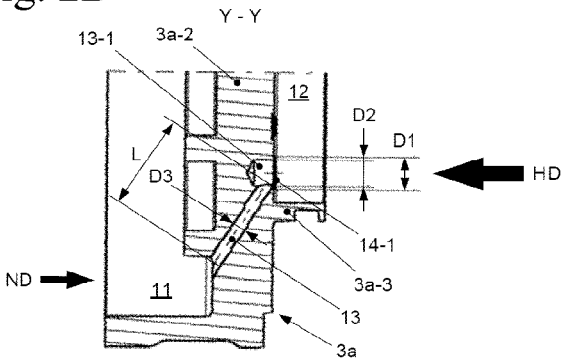

FIG. 2A shows a section through the bypass flow path 13 formed inside the baseplate 3*a*-2 of the stationary spiral 3*a* of the compression mechanism 3 between the suction-pressure chamber 11 and the high-pressure chamber 12 with the device 14-1 for controlling the through-flow in a first alternative embodiment. FIGS. 2B and 2C each show a view from above of the device 14-1 for controlling the through-flow of a first alternative embodiment according to FIG. 2A. FIG. 2D additionally shows a section through the bypass flow path 13 formed between the suction-pressure chamber 11 and the high-pressure chamber 12 with the device 14-1 for controlling the through-flow in the embodiment according to FIG. 2C.

The device 14-1 in the form of a lamellar valve is arranged on a surface, facing the high-pressure chamber 12, of the baseplate 3*a*-2 of the stationary spiral 3*a* to close the bypass flow path 13. During operation of the compressor 1 in compressor mode, the lamellar valve functioning as a non-return valve prevents the compressed fluid expelled from the working chamber 10 at the level of the high-pressure HP into the high-pressure chamber 12 from flowing back into the suction-pressure chamber 11. In the end region facing the high-pressure chamber 12, the bypass flow path 13 is designed as a blind hole 13-1 oriented in the axial direction and thus in the direction of the rotation axis 5.

The device 14-1 designed as a punched-out plate has the shape of a finger and is fixed in the region of a first end, which is also referred to as the fastening region 14-1*a*, to the stationary spiral 3*a*, in particular to the baseplate 3*a*-2 of the stationary spiral 3*a* of the compression mechanism 3. The plate bears against the baseplate 3*a*-2 with the surface facing the high-pressure chamber 12 and is fixed to the baseplate 3*a*-2 in the fastening region 14-1*a*. At a second end, formed distally from the first end, the device 14-1 has a closing region 14-1*b* for closing an end of the bypass flow path 13 in the form of a through-opening. The ends of the finger-shaped device 14-1 are connected to one another via a neck-like connecting region 14-1*c*. Since the connecting region 14-1*c* is designed with a smaller width than the substantially circular closing region 14-1*b*, the device 14-1 has the shape of a spoon when viewed from above.

The connecting region 14-1*c* is designed with both a constant width B and a constant radius R over the length, and therefore the connecting region 14-1*c* of the device 14-1 is designed as a section of a circular ring. The outer radius R of the connecting region 14-1*c* corresponds substantially to an inner radius of a likewise circular ring-shaped elevation 3*a*-3 of the stationary spiral 3*a*. The elevation 3*a*-3 is designed as a wall protruding from the surface of the baseplate 3*a*-2 facing the high-pressure chamber 12, with a diameter D4 of the inwardly facing side. A clearance for moving the device 14-1 is provided between the outer radius R of the connecting region 14-1*c* and the inner radius or the inner diameter D4 of the elevation 3*a*-3.

In the embodiment according to FIG. 2B, the device 14-1 is designed as a single element, while the device 14-1 according to the embodiment of FIG. 2C is connected in the fastening region 14-1*a* to other valves, for example outlet valves, likewise designed as lamellae. The valves and the device 14-1 are designed as an integral or cohesive component, also referred to as a composite.

FIGS. 2C and 2D show the ratios of the dimensions of a bypass flow path 13 formed in the baseplate 3*a*-2 and a device 14-1 closing the bypass flow path 13, in an exemplary embodiment. According to further embodiments, the ratios can vary by factors within the range of 0.1 to 10.

A first ratio between a diameter D1 of the closing region 14-1*b* of the device 14-1 and a diameter D2 of the blind hole 13-1 of the bypass flow path 13 oriented in the axial direction is within the range of 1.25 to 1.75 and ensures the sealing function of the device 14-1.

A second ratio of a flow diameter D3 of the bypass flow path 13 to a length L of the bypass flow path 13 is greater than 0.25. It is thus possible for fluid to flow through the bypass flow path 13 and consequently for the pressure inside the suction-pressure chamber 11 to be reduced without setting the compression mechanism 3 of the compressor 1 in rotation such that a defined voltage level is exceeded.

A third ratio of the diameter D2 of the blind hole 13-1 of the bypass flow path 13 to the flow diameter D3 of the bypass flow path 13 is within the range of 1.05 to 2.1. In an alternative embodiment having a bypass flow path 13 running in the axial direction without a blind hole 13-1, the ratio between the diameter D1 of the closing region 14-1*b* of the device 14-1 and the flow diameter D3 of the bypass flow path 13 is within the range of 1.25 to 1.75. Furthermore, the second ratio of the flow diameter D3 of the bypass flow path 13 and the length L of the bypass flow path 13 is greater than 0.25.

A longitudinal extent A of the device 14-1 is dependent on the position of the bypass flow path 13 inside the baseplate 3*a*-2 of the stationary spiral 3*a*. The width B of the connecting region 14-1*c* has a ratio of 0.1 to the longitudinal extent A. The device 14-1 has a curvature with the radius R, which has a ratio of 0.5 to the diameter D4. In further embodiments, the ratio of the longitudinal extent A of the device 14-1 and the radius R can be within a range of 0.1 to 10. The ratio of the radius R to the diameter D4 can be in the range of 0.3 to infinity when the device 14-1 in particular is designed to be straight in the connecting region 14-1*c* and thus with an infinite radius R.

In the alternative straight design of the device 14-1, the ratio of the width B of the connecting region 14-1*c* to the longitudinal extent A is preferably 0.2.

Since the compressed refrigerant inside the high-pressure chamber 12 is at the level of the high pressure HP, and the refrigerant inside the suction-pressure chamber 11 and the bypass flow path 13 has a level of the low pressure LP in the suction state, the device 14-1 in the form of a lamella is pressed against the surface of the baseplate 3*a*-2 owing to the pressure difference. The pressure at the level of the high pressure HP is greater than the pressure at the level of the low pressure LP.

Figure 3A:
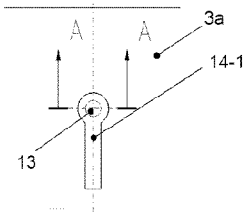
FIGS. 3B and 3C: each show a section through a detail of the bypass flow path formed inside the baseplate of the stationary spiral of the compression mechanism with the device for controlling the through-flow according to FIG. 2A closed and open.
Figure 3B:
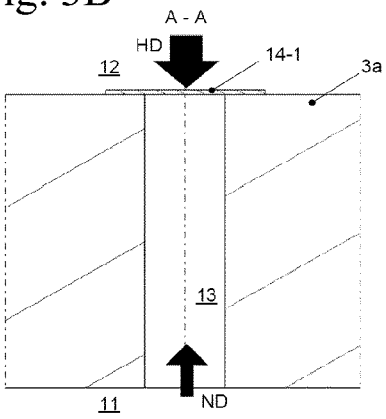
Figure 3C:
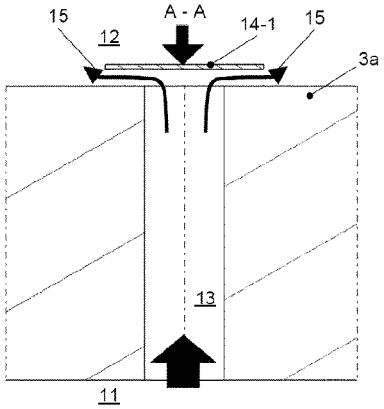

FIG. 3A shows a view from above of a detail of the bypass flow path 13 formed inside the baseplate 3*a*-2 of the stationary spiral 3*a* of the compression mechanism 3 with the device 14-1. FIGS. 3B and 3C each show a section through a detail of the bypass flow path 13 formed inside the baseplate 3*a*-2 of the stationary spiral 3*a* of the compression mechanism 3 with the device 14-1 for controlling the through-flow according to FIG. 2A closed and open.

FIG. 3B shows the operation of the compressor 1 in compressor mode and the arrangement of the device 14-1 of FIG. 2A schematically. The refrigerant which is compressed inside the high-pressure chamber 12 at the level of the high pressure HP presses the device 14-1 in the form of a lamellar valve against the surface of the baseplate 3*a*-2 and in this manner closes the bypass flow path 13. The refrigerant is prevented from overflowing from the high-pressure chamber 12 through the bypass flow path 13 into the suction-pressure chamber 11 in which the refrigerant is at the level of the low pressure LP.

FIG. 3C shows the operation deviating from the operation of the compressor 1 in compressor mode with the electric motor 4 switched off and with a mass flow of the refrigerant in the flow direction 15 through the bypass flow path 13. The bypass flow path 13 is open. The device 14-1 is spaced from the surface of the baseplate 3*a*-2 of the stationary spiral 3*a*. An open gap is formed between the surface of the baseplate 3*a*-2 of the stationary spiral 3*a* and the device 14-1.

In contrast to the operation of the compressor 1 in compressor mode, the refrigerant in the suction-pressure chamber 11 has a higher pressure than the refrigerant inside the high-pressure chamber 12, and therefore the refrigerant pushes the device 14-1 in the form of a lamellar valve away from the surface of the baseplate 3*a*-2 and in this manner opens the bypass flow path 13. Owing to the different pressure levels, the refrigerant flows through the bypass flow path 13 from the suction-pressure chamber 11 into the high-pressure chamber 12.

Such a pressure situation inside the compressor 1 can occur, for example, when the electric motor 4 is taken out of operation, for example by intentional switching off or an unintentional interruption of the supply of electrical energy to the electric motor 4, in particular as a result of an accident. To prevent the refrigerant flowing completely through the compression mechanism 3, like during operation of the compressor 1 in compressor mode, and in the process driving the compression mechanism 3 so that the rotor 4*a* of the electric motor 4 is driven and moved inside the stator 4*b* by the compression mechanism 3, and in this manner an electrical voltage is induced in the coils of the stator 4*b*, which voltage would then be applied to the electrical system of the motor vehicle, at least a portion of the mass flow of the refrigerant is diverted in the flow direction 15 through the bypass flow path 13 and consequently around the compression mechanism 3. This prevents the voltage induced in the coils of the stator 4*b* of the electric motor 4 exceeding certain threshold values.

The bypass flow path 13 can be formed at any suitable point inside or outside the compressor 1 to connect the suction-pressure chamber 11 to the high-pressure chamber 12. The bypass flow path 13 can have any type of pressure-dependent opening mechanism, such as valves or lamellae, for opening and closing.

Figure 4:
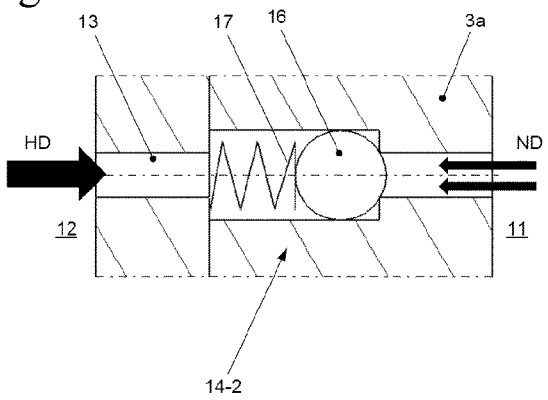
FIG. 4: shows a section through the device for controlling the through-flow in a second alternative embodiment.

FIG. 4 shows a section through the device 14-2 for controlling the through-flow in a second alternative embodiment during operation of the compressor 1 in compressor mode. The device 14-2, which is likewise designed as a non-return valve, is closed. The pressure of the refrigerant in the high-pressure chamber 12 is greater than the pressure in the suction-pressure chamber 11.

The device 14-2 has a spherical closure element 16 and a spring element 17. The spring element 17 is designed as a cylindrical helical spring. The bypass flow path 13 can be closed with the spherical closure element 16. The spring force of the spring element 17 acts on the closure element 16 to close the bypass flow path 13.

When the pressure level of the refrigerant inside the suction-pressure chamber 11 rises relative to the pressure level of the refrigerant inside the high-pressure chamber 12, the closure element 16 is pressed in the direction of the high-pressure chamber 12 counter to the force applied by the spring element 17. The closure element 16 then unblocks the bypass flow path 13 so that the refrigerant can pass through the bypass flow path 13 in the direction of the high-pressure chamber 12. If the pressure level of the refrigerant inside the suction-pressure chamber 11 is too low relative to the pressure level of the refrigerant inside the high-pressure chamber 12, the closure element 16 is pressed by the spring element 17 in the direction of the suction-pressure chamber 11 against a projection formed in the bypass flow path 13 to close the bypass flow path 13. The bypass flow path 13 can, for example, be formed inside the wall of the housing 2 or inside another component arranged between the suction-pressure chamber 11 and the high-pressure chamber 12, such as the baseplate 3*a*-2 of the stationary spiral 3*a*.

Alternatively, the closure element can also have the shape of a truncated circular cone. The truncated circular cone-shaped closure element has in particular a conical cross-section with a base face and a top face, wherein the base face and the top face are parallel to one another. In the closed state, the sloping lateral face of the closure element bears against the projection formed in the bypass flow path 13. The spring force applied by the spring element 17 acts on the base face of the closure element and presses the closure element with its lateral face against the projection formed in the bypass flow path 13 in the closed state.

The spring element can also be designed as a spring plate instead of the cylindrical helical spring. The spring plate can be combined both with the spherical closure element 16 and with the truncated circular cone-shaped closure element.

The device for controlling the through-flow through the bypass flow path 13 can also be designed in any form of a non-return valve.

LIST OF REFERENCE NUMERALS

1 Device, compressor
2 Housing

2*a* First housing element
2*b* Second housing element
3 Compression mechanism
3*a* Stationary spiral
3*a*-*l* Wall of stationary spiral 3*a*
3*a*-2 Baseplate of stationary spiral 3*a*
3*a*-3 Elevation of stationary spiral 3*a*
3*b* Orbiting spiral
3*b*-1 Wall of orbiting spiral 3*b*
3*b*-2 Baseplate of orbiting spiral 3*b*
4 Electric motor
4*a* Rotor
4*b* Stator
5 Rotation axis
6 Drive shaft
7 Eccentric
8*a*, 8*b* Radial bearing of drive shaft 6 on housing 2
9 Radial bearing of movable spiral 3*b* on drive shaft 6
10 Working chamber
11 Suction-pressure chamber
12 High-pressure chamber
13 Bypass flow path
13-1 Blind hole
14-1, 14-2 Device for controlling a through-flow
14-1*a* Fastening region
14-1*b* Closing region
14-1*c* Connecting region
15 Flow direction
16 Closure element
17 Spring element
HP High pressure
LP Low pressure
A Longitudinal extent
B Width of connecting region 14-1*c*
D1 Diameter of closing region 14-1*b*
D2 Diameter of blind hole 13-1
D3 Flow diameter of bypass flow path 13
D4 Diameter of elevation 3*a*-3
L Length of bypass flow path 13
R Radius

The invention claimed is:

1. A device for compressing a gaseous fluid comprising:
a housing;
a compression mechanism for compressing the gaseous fluid; and
an electric motor for driving the compression mechanism, the housing formed with a suction-pressure chamber and a high-pressure chamber, wherein the suction-pressure chamber is disposed upstream of the compression mechanism and includes the gaseous fluid prior to compression within the compression mechanism, and wherein the high-pressure chamber is disposed downstream of the compression mechanism and receives the gaseous fluid following compression thereof within the compression mechanism, wherein a bypass flow path and a device for controlling a through-flow of the gaseous fluid through the bypass flow path are formed, wherein the bypass flow path directly fluidly couples the suction-pressure chamber to the high-pressure chamber, and wherein the device for controlling the through-flow is designed to open the bypass flow path solely for the gaseous fluid to flow therethrough in a flow direction from the suction-pressure chamber into the high-pressure chamber in reaction to a pressure of the gaseous fluid within the suction-pressure chamber being greater than a pressure of the gaseous fluid within the high-pressure chamber, wherein the compression mechanism has a stationary spiral and an orbiting spiral, wherein the stationary spiral and the orbiting spiral are each formed with a baseplate and a spiral-shaped wall extending from the baseplate, wherein the spiral shaped wall of the stationary spiral and the spiral shaped wall of the orbiting spiral are arranged to engage in one another and to form working chambers, and wherein the bypass flow path is formed inside the stationary spiral or inside a wall of the housing, or outside the housing, wherein the device for controlling the through-flow is a lamellar valve.

2. The device according to claim 1, wherein the bypass flow path is designed as a through-opening through the baseplate of the stationary spiral.

3. The device according to claim 1, wherein the device for controlling the through-flow has a fastening region and a closing region, which are connected to one another via a neck-like connecting region.

4. The device according to claim 3, wherein the connecting region is formed over a length with a constant width which is smaller than a diameter of the substantially circular closing region.

5. The device according to claim 4, wherein the device for controlling the through-flow has a longitudinal extent, wherein a ratio of the width of the connecting region to the longitudinal extent is 0.1.

6. A method for operating the device for compressing the gaseous fluid, having the housing with the suction-pressure chamber and the high-pressure chamber, and the bypass flow path flow-connecting the suction-pressure chamber and the high-pressure chamber to one another, and the device for controlling the through-flow through the bypass flow path according to claim 1, the method having steps of:
closing the bypass flow path during operation of the device for compressing the gaseous fluid in a compressor mode, and
opening the bypass flow path to allow the gaseous fluid to flow through in the flow direction from the suction-pressure chamber into the high-pressure chamber, wherein the flow direction of the gaseous fluid is set by pressure levels of the gaseous fluid inside the suction-pressure chamber and the high-pressure chamber.

7. A device for compressing a gaseous fluid comprising:
a housing:
a compression mechanism for compressing the gaseous fluid; and
an electric motor for driving the compression mechanism, the housing formed with a suction-pressure chamber and a high-pressure chamber, wherein the suction-pressure chamber is disposed upstream of the compression mechanism and includes the gaseous fluid prior to compression within the compression mechanism, and wherein the high-pressure chamber is disposed downstream of the compression mechanism and receives the gaseous fluid following compression thereof within the compression mechanism, wherein a bypass flow path and a device for controlling a through-flow of the gaseous fluid through the bypass flow path are formed, wherein the bypass flow path directly fluidly couples the suction-pressure chamber to the high-pressure chamber, and wherein the device for controlling the through-flow is designed to open the bypass flow path solely for the gaseous fluid to flow therethrough in a flow direction from the suction-pressure chamber into the high-pressure chamber in reaction to a pressure of the gaseous fluid within the suction-pressure chamber being greater than a pressure of the gaseous fluid within the high-pressure chamber, wherein the compression mechanism has a stationary spiral and an orbiting spiral, wherein the stationary spiral and the orbiting spiral are each formed with a baseplate and a spiral-shaped wall extending from the baseplate, wherein the spiral shaped wall of the stationary spiral and the spiral shaped wall of the orbiting spiral are arranged to engage in one another and to form working chambers, wherein the device for controlling the through-flow is a lamellar valve, and wherein the device for controlling the through-flow is arranged to bear against a surface, facing the high-pressure chamber, of the baseplate of the stationary spiral and to close the bypass flow path when in the closed state.

8. A device for compressing a gaseous fluid comprising:

a housing;

a compression mechanism for compressing the gaseous fluid; and an electric motor for driving the compression mechanism, the housing formed with a suction-pressure chamber and a high-pressure chamber, wherein the suction-pressure chamber is disposed upstream of the compression mechanism and includes the gaseous fluid prior to compression within the compression mechanism, and wherein the high-pressure chamber is disposed downstream of the compression mechanism and receives the gaseous fluid following compression thereof within the compression mechanism, wherein a bypass flow path and a device for controlling a through-flow of the gaseous fluid through the bypass flow path are formed, wherein the bypass flow path directly fluidly couples the suction-pressure chamber to the high-pressure chamber, and wherein the device for controlling the through-flow is designed to open the bypass flow path solely for the gaseous fluid to flow therethrough in a flow direction from the suction-pressure chamber into the high-pressure chamber in reaction to a pressure of the gaseous fluid within the suction-pressure chamber being greater than a pressure of the gaseous fluid within the high-pressure chamber, wherein the device for controlling the through-flow is a lamellar valve, wherein the compression mechanism has a stationary spiral and an orbiting spiral, wherein the stationary spiral and the orbiting spiral are each formed with a baseplate and a spiral-shaped wall extending from the baseplate, wherein the spiral shaped wall of the stationary spiral and the spiral shaped wall of the orbiting spiral are arranged to engage in one another and to form working chambers, wherein the device for controlling the through-flow has a fastening region and a closing region, which are connected to one another via a neck-like connecting region, and wherein the device for controlling the through-flow in the form of the lamellar valve and at least one outlet valve in the form of a lamellar valve are connected to one another at first ends, forming the fastening region, to form an integral unit, wherein the device for controlling the through-flow and the at least one outlet valve are arranged oriented in a common plane.

9. A device for compressing a gaseous fluid comprising:

a housing;

a compression mechanism for compressing the gaseous fluid; and an electric motor for driving the compression mechanism, the housing formed with a suction-pressure chamber and a high-pressure chamber, wherein the suction-pressure chamber is disposed upstream of the compression mechanism and includes the gaseous fluid prior to compression within the compression mechanism, and wherein the high-pressure chamber is disposed downstream of the compression mechanism and receives the gaseous fluid following compression thereof within the compression mechanism, wherein a bypass flow path and a device for controlling a through-flow of the gaseous fluid through the bypass flow path are formed, wherein the bypass flow path directly fluidly couples the suction-pressure chamber to the high-pressure chamber, and wherein the device for controlling the through-flow is designed to open the bypass flow path solely for the gaseous fluid to flow therethrough in a flow direction from the suction-pressure chamber into the high-pressure chamber in reaction to a pressure of the gaseous fluid within the suction-pressure chamber being greater than a pressure of the gaseous fluid within the high-pressure chamber, wherein the compression mechanism has a stationary spiral and an orbiting spiral, wherein the stationary spiral and the orbiting spiral are each formed with a baseplate and a spiral-shaped wall extending from the baseplate, wherein the spiral shaped wall of the stationary spiral and the spiral shaped wall of the orbiting spiral are arranged to engage in one another and to form working chambers, wherein the device for controlling the through-flow has a fastening region and a closing region, which are connected to one another via a neck-like connecting region, and wherein the device for controlling the through-flow is fixed at a first end with the fastening region to the baseplate of the stationary spiral and is arranged so as to be able to close the bypass flow path with a free second end, formed distally from the first end, with the closing region.

10. A device for compressing a gaseous fluid comprising:

a housing;

a compression mechanism for compressing the gaseous fluid; and an electric motor for driving the compression mechanism, the housing formed with a suction-pressure chamber and a high-pressure chamber, wherein the suction-pressure chamber is disposed upstream of the compression mechanism and includes the gaseous fluid prior to compression within the compression mechanism, and wherein the high-pressure chamber is disposed downstream of the compression mechanism and receives the gaseous fluid following compression thereof within the compression mechanism, wherein a bypass flow path and a device for controlling a through-flow of the gaseous fluid through the bypass flow path are formed, wherein the bypass flow path directly fluidly couples the suction-pressure chamber to the high-pressure chamber, and wherein the device for controlling the through-flow is designed to open the bypass flow path solely for the gaseous fluid to flow therethrough in a flow direction from the suction-pressure chamber into the high-pressure chamber in reaction to a pressure of the gaseous fluid within the suction-pressure chamber being greater than a pressure of the gaseous fluid within the high-pressure chamber, wherein the compression mechanism has a stationary spiral and an orbiting spiral, wherein the stationary spiral and the orbiting spiral are each formed with a baseplate and a spiral-shaped wall extending from the baseplate, wherein the spiral shaped wall of the stationary spiral and the spiral shaped wall of the orbiting spiral are arranged to engage in one another and to form working chambers, wherein the device for controlling the through-flow has a fastening region and a closing region, which are connected to one another via a neck-like connecting region, wherein the connecting region is formed over a length with a constant width which is smaller than a diameter of the substantially circular closing region, and wherein the connecting region has a constant outer radius such that the connecting region is a section of a circular ring.

11. The device according to claim 10, wherein the outer radius of the connecting region corresponds to an inner radius of a circular ring-shaped elevation protruding from a surface, facing the high-pressure chamber, of the baseplate of the stationary spiral, minus a clearance for a movement of the device for controlling the through-flow relative to the stationary spiral.

12. The device according to claim 10, wherein the device for controlling the through-flow has a longitudinal extent, wherein a ratio of the longitudinal extent to the outer radius of the connecting region has values within a range of 0.1 to 10.

* * * * *